United States Patent [19]

Haldimann

[11] 4,023,501

[45] May 17, 1977

[54] SPEED CONTROL DEVICE

[76] Inventor: Hans Rudolf Haldimann, Restellberstrasse 65 Zurich, Switzerland

[22] Filed: Feb. 20, 1975

[21] Appl. No.: 551,236

[30] Foreign Application Priority Data

Feb. 22, 1974 Switzerland ..... 2662/74

[52] U.S. Cl. ..... 104/147 R; 104/168

[51] Int. Cl.[2] ..... B61B 13/12

[58] Field of Search ..... 104/1 R, 26 A, 147 R, 104/165, 168, 172 B, 188, 187, 88

[56] References Cited

UNITED STATES PATENTS

| | | | |
|---|---|---|---|
| 2,954,744 | 10/1960 | Bonner | 104/168 |
| 3,013,499 | 12/1961 | Hubert | 104/165 |
| 3,530,800 | 9/1970 | Watkins | 104/168 |

FOREIGN PATENTS OR APPLICATIONS

| | | | |
|---|---|---|---|
| 1,405,537 | 1/1969 | Germany | 104/168 |

*Primary Examiner*—Robert J. Spar
*Assistant Examiner*—James M. Slattery

[57] ABSTRACT

A speed control device for controlling the speed of a transport vehicle rolling on a rail track, especially for use in a shelf storage system in which a pair of spaced apart rails form part of the structure of a warehouse shelf and constitutes the supporting and guiding track for the vehicle, the transport vehicle being supported on the rails and wherein a rotating braking and accelerating member is provided for the vehicle. The speed control device for driving the braking and accelerating member drives at a predetermined speed. The braking and accelerating member consists essentially of a spring-tensioned endless belt, a fixed subframe, bracket support member, and a spring member. The belt is resiliently supported on the fixed subframe and is able to move from a rest position which is out of engagement with the driving member but in the path of said vehicle to a working position which is in engagement with the driving member and in frictional engagement with the vehicle. The resilient movement of the belt from the rest position to the working position and back is effected by the passing vehicle itself and is opposite to the force of said spring members. Roller members are provided including axles which rests upon openings in the bracket support, the necks of the axles resting against the upper portions of the openings in the bracket support to provide braking and accelerating members. A disc on the ends of said axles prevent the spring from jumping off the necks of the axles.

4 Claims, 6 Drawing Figures

SPEED CONTROL DEVICE

BACKGROUND OF THE INVENTION

1. Field of the Invention

The present invention relates to a speed control device for controlling the speed of a vehicle rolling on a rail track. Especially, it refers to a speed controlling device for controlling the speed of a freely running transport vehicle in a shelf storage system. The device comprises a rotating breaking and accelerating means driveable at a predetermined speed and engageable with a vehicle passing the speed control device to decrease or increase the speed of the vehicle.

2. Description of the Prior Art

Speed control devices are used in automatically operated shelf storage systems, where the transport vehicles loaded with goods are not only used for storing the goods but also for transporting the goods from a receiving station to a storing station and therefrom to a exit station. The movement of such vehicles is effected by an inclination of the rail track. It is quite evident, that, therefore, the speed of these vehicles is not well predetermined, but rather varies considerably, depending on the load on the vehicle. On the other hand, it is imperative to hold the speed of the transport vehicles within certain limits. The speed may not become excessive, in order to prevent the load from being off-centered or even from falling down from the vehicle or to prevent the vehicle from jumping out of the rail track. On the other hand, there must be provided a certain minimal speed in order to prevent a vehicle from stopping, which would lead to critical situations or accidents.

OBJECTS OF THE INVENTION

It is an object of the present invention to propose a speed control device to accelerate vehicles rolling too slowly and to decrease the speed of vehicles rolling to fast. Another object of the present invention is to provide a speed control device which effects this accelerating as gently as possible in order to prevent an off-centering of the load on the vehicle. Still another object of the present invention is to provide a speed control device which works absolutely reliably and with a minimum of maintenance, because in shelf storage systems it is most important to have an operation as troublefree and automatic as possible. Still another object of the present invention is to provide a speed control device with a very simple and inexpensive construction, because usually there is a need for a considerable number of such devices in a single warehouse. Finally, it should be noted that the energy consumption should be as little as possible. The speed control device according to the present invention fulfills all the needs listed above.

SUMMARY OF THE INVENTION

According to the present invention, the speed control device is characterized in that the breaking and accelerating means are in the form of an endless belt, which is resiliently supported on a fixed frame and which is able to be moved from a rest porition, where it extends with an upper part of the belt into the moving path of the vehicle and where it is disengaged from the driving means, in a working position, where it is engaged with the driving means, whereby this resilient movement from the rest position to the working position and back to the rest position is effected under influence of the passing vehicle itself, opposite to the force of spring means.

BRIEF DESCRIPTION OF THE DRAWING

The invention will be described further, by way of example, with reference to the accompanying drawings, in which.

DESCRIPTION OF THE PREFERRED EMBODIMENT

Figure 1:
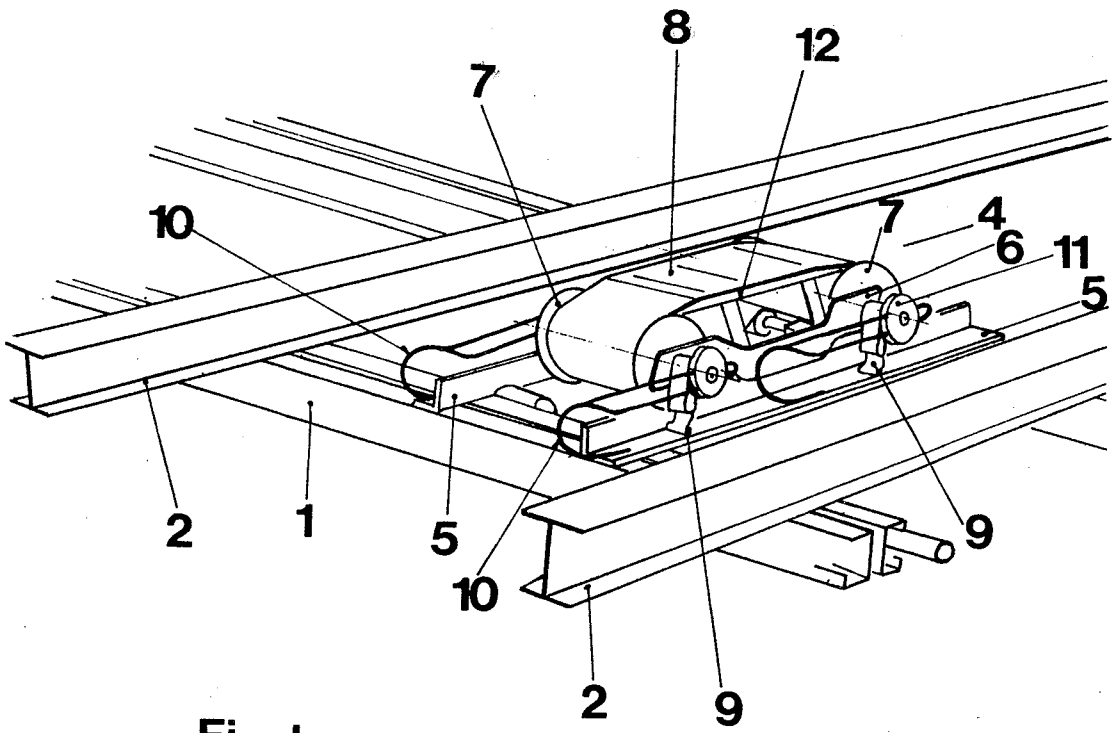
FIG. 1 is a perspective view of a speed control device according to the invention, mounted between the rails of a rail track.
Figure 2:
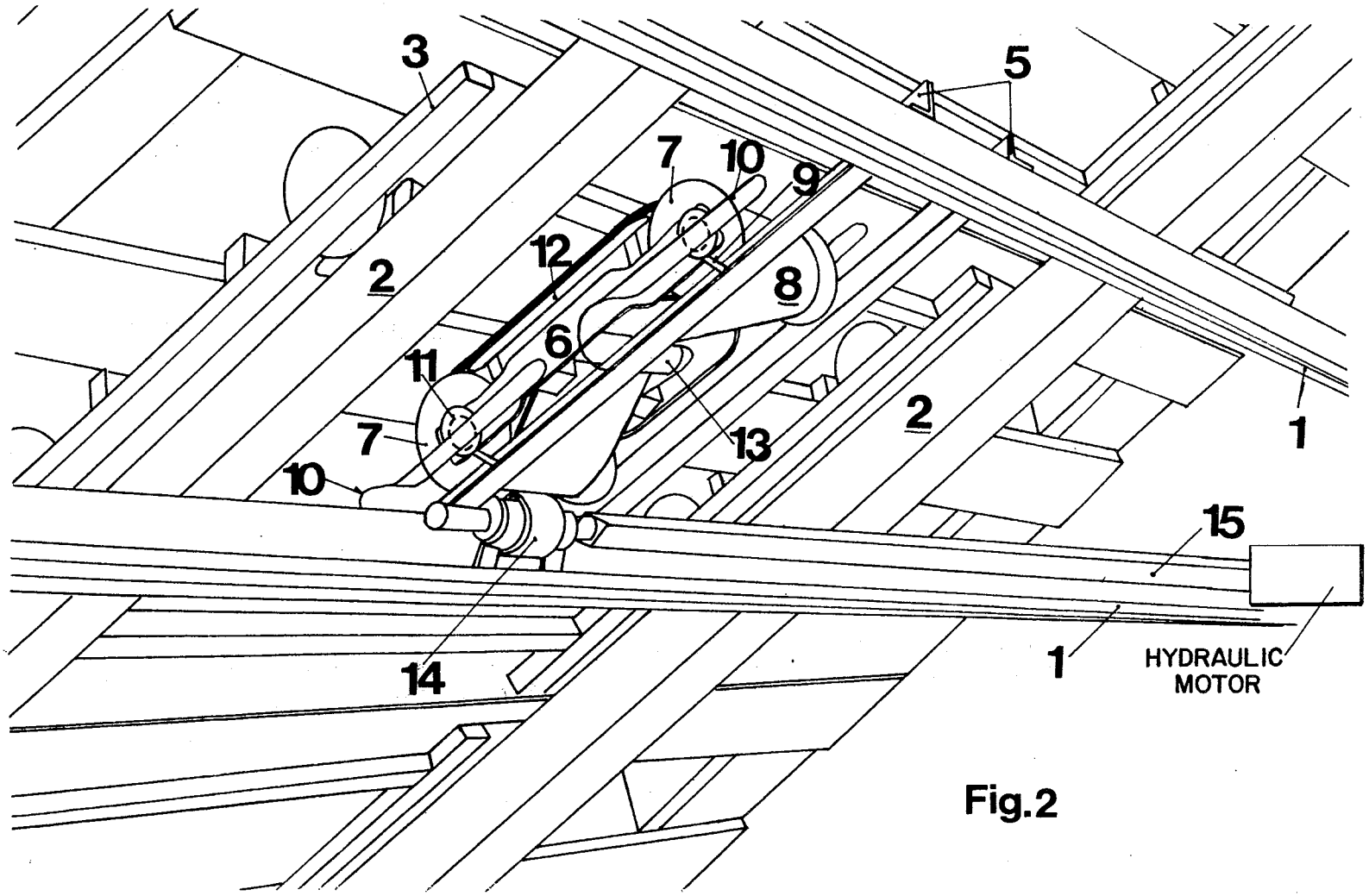
FIG. 2 is a perspective view of the device in FIG. 1, but seen from below.

The following description firstly refers to FIGS. 1 and 2 in order to explain the constructional details of the speed control device according to the present invention.

As can be clearly seen from FIG. 1, there are provided two rails 2, which are supported by crossmembers 1, these forming part of the structure of a warehouse shelf. The rails 2 are provided to support and guide a transport vehicle 3. The speed control device is designated as a whole by reference number 4 and is arranged, as can be clearly seen from the drawing, in the space between the pair of rails 2. The speed control device comprises two longitudinal members 5, e.g. iron bars with an L-shaped cross section, which extend parallel to the rails 2. The members 5 are provided to support a subframe 6 comprising two rollers 7 which are freely rotatable beared on the subframe 6 in distance from each other. The said two rollers 7 are surrounded by a endless belt 8. The subframe 6 is supported on the members 5 by means of brackets 9, which surround the four necks of the axles of the rollers 7 portruding over the subframe 6. The brackets 9 are provided, on their one end, with a longitudinally arranged opening provided to receive the necks of the axles, while they are, on the other end, pivotally connected to the members 5. Further, there are provided springs 10 mounted on the members 5 as well, which exert a force on the necks of the axles in an upward direction, i.e. towards the vehicle rolling on the rail track.

The necks of the axles of the rollers 7 rest against the upper end of the longitudinal opening in the brackets 9. In order to prevent the springs 10 against the jumping off the axle necks, there are provided discs 11 put on the end of the axles of the rollers 7. In the region of the upper part of the belt 8, there is provided a supporting member 12 for supporting the belt 8, while in the region of the lower part of the belt 8, there is provided a tensioning means 13 ensuring a predetermined tension of the belt 8.

Referring now to FIG. 2, there can be seen that one of the cross members 1 supports a roller 14, which is driven via a shaft 15 by driving means, e.g. a hydraulic motor. The roller 14 has a circumferential layer of a material with a high friction coefficient. The periphery of the roller 14 is pressed against the outer side of the belt 8 in order to drive the same. It should be noted that via shaft 15 more than one roller 14 can be driven (not shown), in the case that more than one speed control devices are provided, as is usual in a warehouse with a considerable number of rail tracks arranged besides each other.

The belt 8 is provided, on its outer side, with a layer of a material with a high friction coefficient, on the one hand to ensure a good frictional contact with the roller 14, on the other hand to ensure a positive engagment with a vehicle passing the speed control device.

Referring to FIGS. 3 to 6, there will be given now a description and explanation of the mode of operation of the speed control device according to the present invention.

Figures 3, 4, 5, 6:
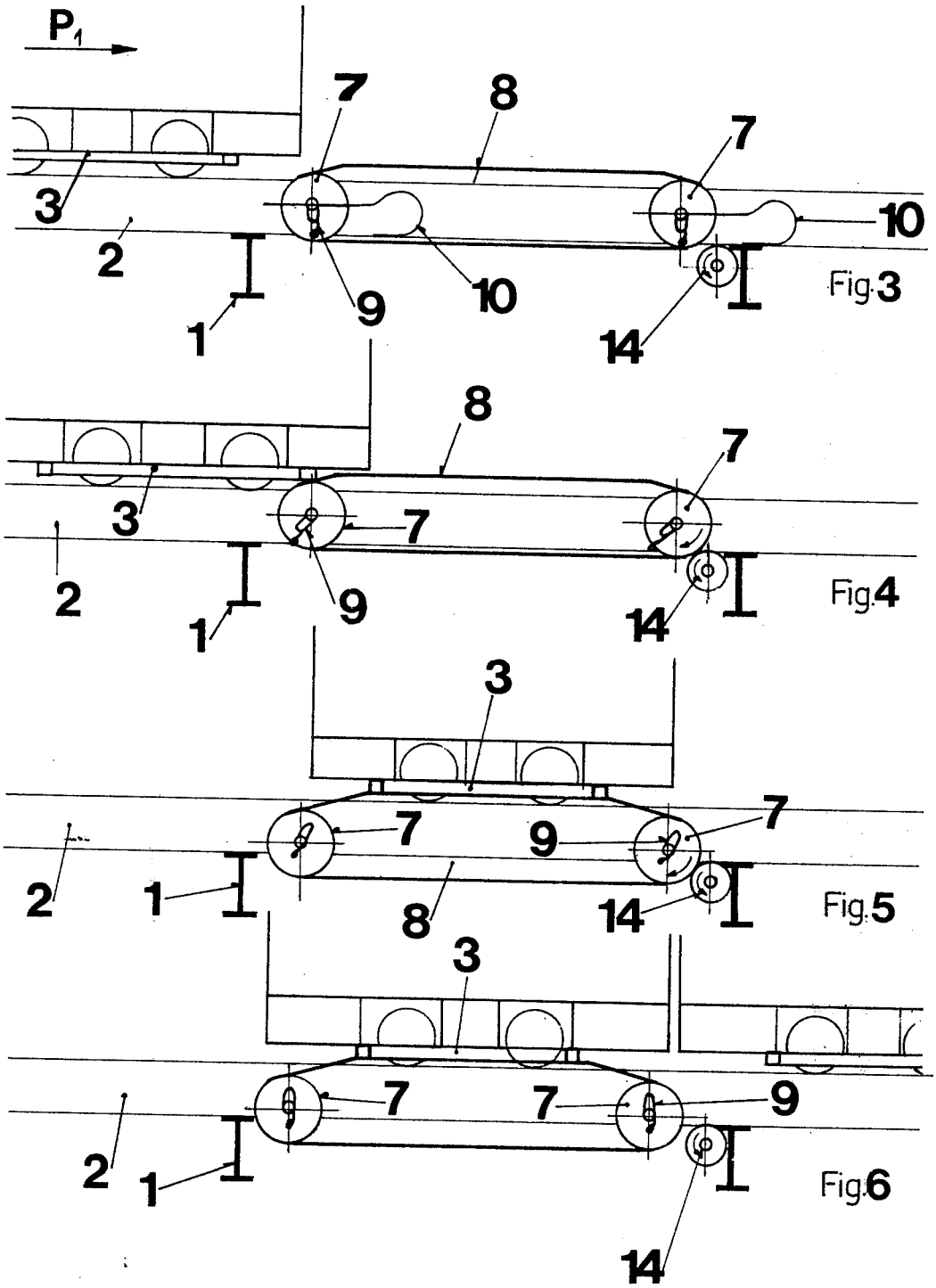
FIG. 3 to 6 are schematic side views of the speed control device, shown in four different phases of operation.

In FIG. 3, the speed control device is in the rest position, while a vehicle 3, rolling in the direction of arrow $P_1$, travels along the rail track 2 towards the speed control device. It can be clearly seen from FIG. 3, that the belt 8 is disengaged from the continuously driven roller 14: it is therefor stopped. The springs 10 press the belt in an upwards direction, so that an upper area of the belt 8 is reaching in the path of movement of the vehicle 3.

As soon as the vehicle 3 has reached the front end of the belt 8 (FIG. 4) the belt 8 and simultaneously the subframe 6 is pushed forward and downwards. This is accomplished by the resilient connection of the subframe 6 on the memberrs 5, opposite to the force of the springs 10, by means of the brackets 9. Now the roller 14 engages the belt 8 and, due to frictional contact between roller 14 and belt 8, the latter starts to rotate in the direction of the little arrows in FIG. 4. The revolving speed of roller 14 and, consequently, of belt 8 too is adjusted to a predetermined, exactly defined value.

Referring now to FIG. 5, there can be seen, that the upper area of the belt has engaged the lower side of the vehicle 3. Due to the frictional layer on the outer side of the belt 8, there will be, after a certain time, s positive contact between vehicle 3 and belt 8, which rotates at a selected speed, so that the speed of the vehicle 3 will be the same as that of the belt 8, independent of whether the speed of the vehicle 3 was higherr or lower than the revolving speed of the belt 8. In the first named case, the speed control device has the effect of a brake, while in the second case, the speed control device will accelerate the speed of the vehicle 3.

The less the difference is speed between vehicle 3 and belt 8, the less will be the force with which the belt ant therewith the subframe is pushed forward and downward. If the said speed difference is zero, there doesn't exist any force to put the subframe 6 downwards and, consequently, the roller 14 is disengaged from the belt 8.

If the free path of the vehicles 3 is obstructed by any reason, see FIG. 6, the roller 14 and the belt 8 will disengage also and the roller 14 rotates freely. As soon as the obstruction has disappeared, the vehicles 3 start rolling due to the inclination of the rails 2 and the speed control device starts to operate again, i.e. it will accelerate the vehicle above it.

As soon as a vehicle has left the region of the speed control device, the springs 10 force the subframe and, therewith, the blet 8 back in the rest position, as shown in FIG. 3. It should be noted, that the springs are not shown in FIGS. 3 to 6 for simplicity's sake.

By means of the speed control device according to the present invention, there is provided a very simple and efficient means for regulating the speed of a free running vehicle on a rail track. In it's rest position, as can be seen from FIG. 3, the belt 8 disengaged from roller 14, the latter is freely revolving, thereby absorbing only a very small amount of energy. In the case of an obstruction the speed control device will immediately disengage, and damage to the vehicle or speed control device is thereby avoided. The device is very simple in construction and ensures, even in mass production, uniformity in operation and also ensures that departures from the control characteristics of the control device remain very low. The only parts subjected to a considerable wear are the belt 8 and the roller 14, but these parts can rapidly be replaced if necessary.

What we claim is:

1. A speed control device for controlling the speed of a transport vehicle rolling on a rail track, especially for use in a shelf storage system, comprising:

a pair of spaced apart rails forming part of the structure of a warehouse shelf and constituting the supporting and guiding track for the vehicle;

a transport vehicle supported on said rails;

a revolving braking and accelerating means for said vehicle;

a predetermined speed driving means for driving said braking and acceleratingmeans;

said braking and accelerating means consisting essentially of a spring-tensioned endless belt, a fixed subframe, bracket support means, and a spring means;

said belt being resiliently supported on said fixed subframe and being able to move from a rest position, which is out of engagement with said driving means but in the path of said vehicle to a working position which is in engagement with said driving means and in frictional engagement with the vehicle, the resilient movement of said belt from said rest position to said working position and back being effected by means of the passing vehicle itself and being opposite to the force of said spring means;

roller means including axles which rests upon openings in said bracket means, the necks of the axles resting against the upper portions of the openings in said bracket support means of said braking and accelerating means; and, disc means on the ends of said axles to prevent said spring means from jumping off the necks of said axles.

2. A speed control device according to claim 1, in which said endless belt is supported and guided by means of two rollers, which are fixedly arranged in spaced apart relation distance from each other, the two rollers being moveable relative to the rail track.

3. A speed control device according to claim 2, in which said rollers are supported by means of two brackets for each roller, which are connected to cross members, each of said brackets comprising a longitudinal opening for receiving the necks of the axles of the rollers.

4. A speed control device according to claim 3, in which said spring means resting against the necks of the axles of the rollers and pushes them against the far end of said longitudinal openings in the brackets.

* * * * *